US005410336A

United States Patent [19]

Ono et al.

[11] Patent Number: 5,410,336

[45] Date of Patent: Apr. 25, 1995

[54] RECORDING METHOD AND APPARATUS FOR CONTROLLING INK SHEET CONVEYANCE IN ACCORDANCE WITH AN INTERVAL BETWEEN RECORDING OPERATIONS

[75] Inventors: Takeshi Ono, Yokohama; Takehiro Yoshida, Tokyo; Hisao Terajima, Yokohama; Satoshi Wada, Kawasaki; Makoto Kobayashi, Tama; Yasushi Ishida, Tokyo; Akihiro Tomoda, Yokohama; Minoru Yokoyama, Yokohama; Takashi Awai, Yokohama, all of Japan

[73] Assignee: Canon Kabushiki Kaisha, Tokyo, Japan

[21] Appl. No.: 62,169

[22] Filed: May 17, 1993

Related U.S. Application Data

[63] Continuation of Ser. No. 825,773, Jan. 21, 1992, abandoned, which is a continuation of Ser. No. 415,958, Oct. 2, 1989, abandoned.

[30] Foreign Application Priority Data

Oct. 4, 1988 [JP] Japan ..... 63-248981

[51] Int. Cl.[6] ..... B41J 2/315

[52] U.S. Cl. ..... 347/215; 358/298; 400/232; 400/513; 400/583

[58] Field of Search ..... 358/296; 346/76 PH, 346/1.1; 400/120, 232, 224.1, 224.2, 236, 236.2

[56] References Cited

U.S. PATENT DOCUMENTS

| | | | |
|---|---|---|---|
| 4,456,392 | 6/1984 | Nozaki et al. | 400/120 |
| 4,709,149 | 11/1987 | Takahashi et al. | 250/317 |
| 4,717,967 | 1/1988 | Yoshida | 358/296 |
| 4,724,447 | 2/1988 | Oda | 346/76 PH |
| 4,768,100 | 8/1988 | Kunishima et al. | 358/285 |
| 4,814,789 | 3/1989 | Ono | 346/76 PH |
| 4,873,536 | 10/1989 | Minowa et al. | 346/76 PH |
| 4,875,056 | 10/1989 | Ono | 346/76 PH |

FOREIGN PATENT DOCUMENTS 59-14981 1/1984 Japan .

OTHER PUBLICATIONS

Eur. Pat. Off. Search Rep. for Eur. Pat. App. 89118404.6.

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

In a heat transfer recording apparatus, ink of an ink sheet is transferred to a recording medium to record images on the recording medium. The apparatus includes conveying motors for the ink sheet and recording medium, and a timer for counting a recording interval from the termination of the image recording until the next conveyance of the ink sheet or recording medium is started. A waiting time is determined which corresponds to the recording interval. The apparatus is controlled so that image recording is effected on the recording medium after the lapse of the waiting time after the start of ink sheet conveyance.

31 Claims, 6 Drawing Sheets

RECORDING METHOD AND APPARATUS FOR CONTROLLING INK SHEET CONVEYANCE IN ACCORDANCE WITH AN INTERVAL BETWEEN RECORDING OPERATIONS

This application is a continuation, of application Ser. No. 07/825,773 filed Jan. 21, 1992, now abandoned and which was a continuation of application Ser. No. 07/415,958 filed Oct. 2, 1989, now also abandoned.

BACKGROUND OF THE INVENTION

1. Field of the Invention

This invention relates to a heat transfer recording apparatus for transferring the ink of an ink sheet to a recording medium to thereby record images on a recording medium, and a facsimile apparatus.

The term "heat transfer recording apparatus" covers, for example, a facsimile apparatus, an electronic typewriter, a copying apparatus, a printer apparatus, etc.

2. Related Background Art

Generally, a heat transfer printer uses an ink sheet comprising a base film having heat-meltable (or heat-sublimating) ink applied thereto, selectively heats the ink sheet by a thermal head in conformity with an image signal, and transfers the melted (or sublimated) ink to the recording sheet to thereby accomplish image recording. Generally, this ink sheet is such that the ink is completely transferred to the recording paper by one operation of image recording (a so-called one time sheet) and therefore, after the termination of recording of one character or one line, it has been necessary to convey the ink sheet by an amount corresponding to the length of the record, and then reliably bring the unused portion of the ink sheet to a recording position. This has increased the quantity of ink sheets used, and there has been the tendency that as compared with the ordinary thermosensitive printer which effects recording on thermosensitive paper, the running cost of the heat transfer printer becomes high.

In order to solve such a problem, there has been proposed a heat transfer printer as shown in U.S. Pat. No. 4,456,392, Japanese Laid-Open Patent Application No. 58-201686 or Japanese Patent Publication No. 62-58917 wherein recording paper and an ink sheet are conveyed with a velocity difference provided therebetween. As described in the aforementioned publications, an ink sheet capable of plural (n) times of image recording (a so-called multiprint sheet) is known, and if such an ink sheet is used, when a recording length L is to be continuously recorded, recording can be accomplished with the conveyance length of the ink sheet which is conveyed after or during the recording of each image being made smaller than the length L ($L/n: n>1$). Thus, the efficiency of use of the ink sheet increases to n times and a reduction in the running cost of the heat transfer printer can be expected. This recording system is called multiprint.

In such multiprint system, there has been the undesirable possibility that immediately after the start of image recording, the recording paper and the ink sheet stick to each other to prevent multiprint from being accomplished properly. Also, when intermittent recording is effected as during the image reception in a facsimile apparatus, printing is sometimes started from a state in which the ink sheet and the recording paper are completely stopped. In such case, there is the undesirable possibility that even if an electrical energization signal is output to a conveying motor for the conveyance of the ink sheet, the electrical energization of a thermal head is started and the recording operation is executed before the conveying motor for the ink sheet actually starts rotation and the conveyance of the ink sheet has begun. In such a case, image recording is effected with the ink sheet remaining stopped relative to the recording paper, and this has led to the undesirable possibility that the color forming area becomes smaller or the ink sheet and the recording paper stick to each other as previously mentioned.

SUMMARY OF THE INVENTION

It is an object of the present invention to provide a heat transfer recording apparatus and a facsimile apparatus which can improve the quality of a recorded image.

It is another object of the present invention to provide a heat transfer recording apparatus and a facsimile apparatus which can decrease the quantity of ink sheet consumed.

It is still another object of the present invention to provide a heat transfer recording apparatus and a facsimile apparatus which can reduce the running cost.

It is yet still another object of the present invention to provide a heat transfer recording apparatus and a facsimile apparatus in which after the conveyance driving of an ink sheet, image recording is effected in a time corresponding to the recording interval, whereby a relative velocity is reliably created between a recording medium and the ink sheet during image recording.

DESCRIPTION OF THE PREFERRED EMBODIMENT

A preferred embodiment of the present invention will hereinafter be described in detail with reference to the accompanying drawings.

The embodiment which will hereinafter be described is a heat transfer recording apparatus in which the recording interval from the termination of image recording until the next conveyance of the ink sheet or recording medium. Waiting time is determined correspondingly to the recording interval counted by the time counting means and which operates so as to effect the recording of an image on a recording medium after the waiting time elapses after the start of the conveyance of an ink sheet by conveying means for conveying the ink sheet. Also, the embodiment is a facsimile apparatus in which during the recording of a received image or an image signal from image input means, the recording interval from the termination of image recording until the next conveyance of the ink sheet or recording medium is counted by the counting means and the waiting time is determined correspondingly to the interval counted by the time counting means and which operates so as to effect the recording of the next image signal on a recording medium when the determined waiting time elapses after the start of the conveyance of an ink sheet by conveying means for conveying the ink sheet.

Figure 1:
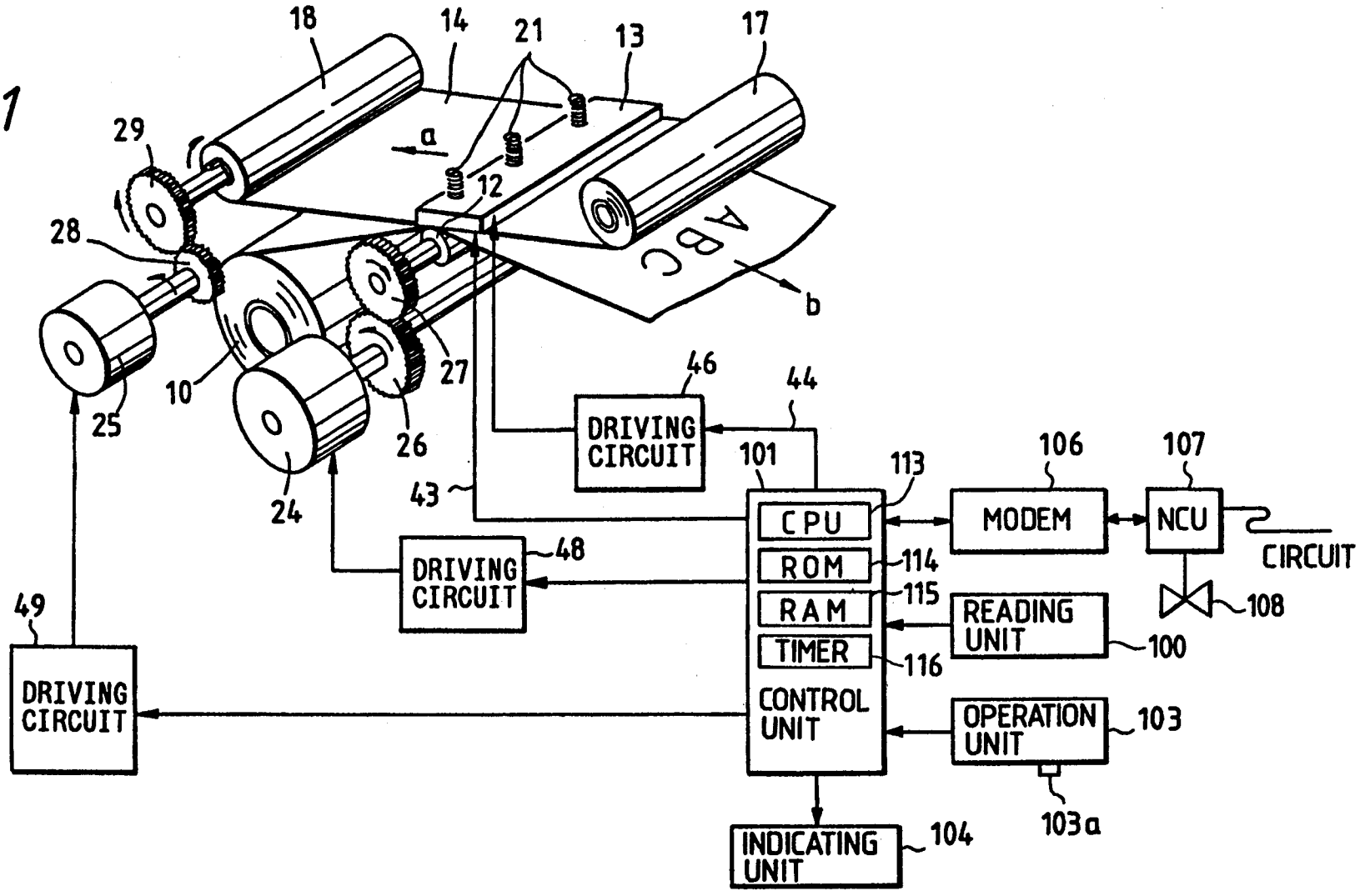
FIG. 1 is a block diagram schematically showing the construction of a facsimile apparatus to which an embodiment of the present invention is applied and the construction of a conveyance driving system for recording paper and an ink sheet.

Description of Facsimile Apparatus (FIGS. 1 and 2)

Figure 2A:
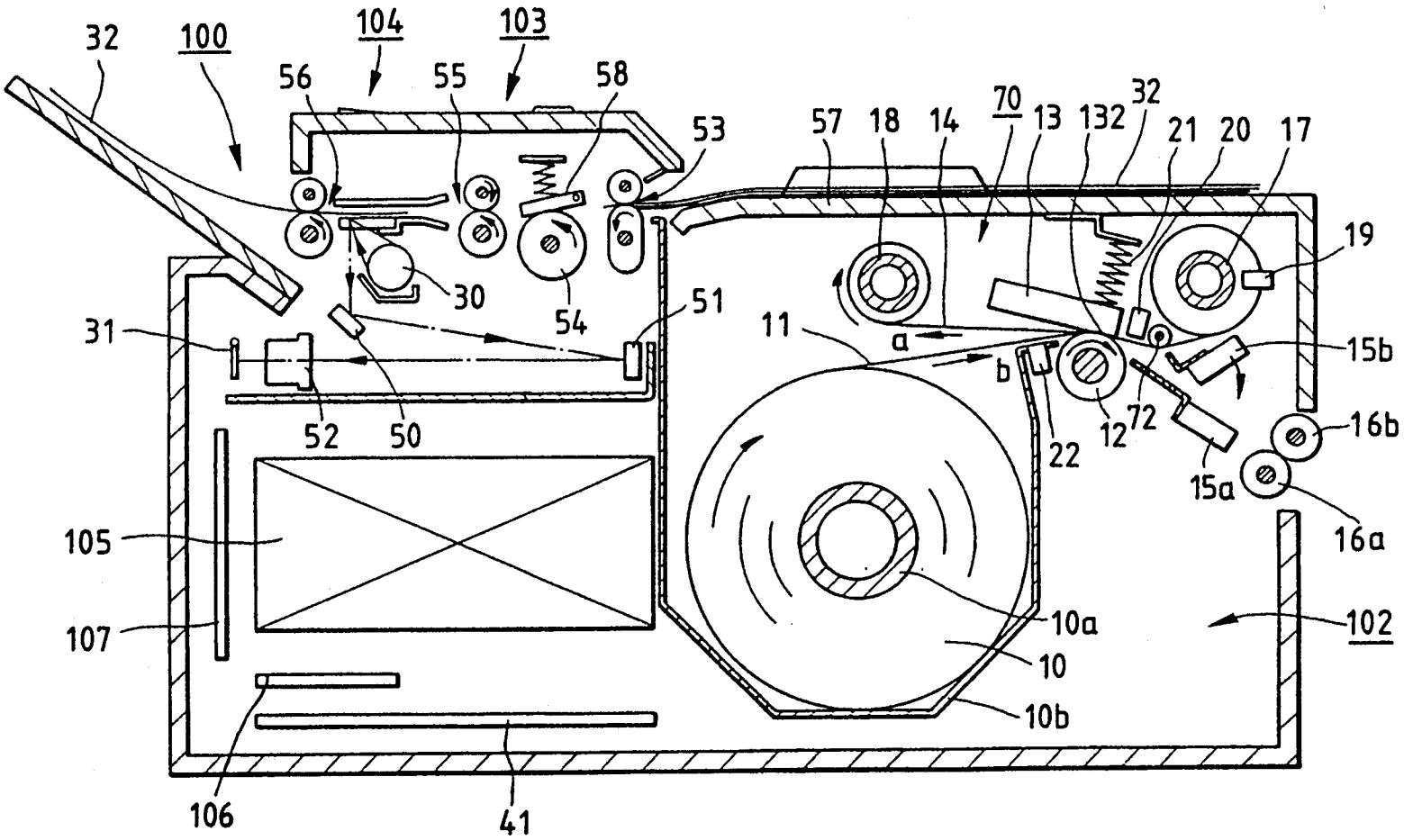
FIG. 2A is a side cross-sectional view showing the mechanism portion of the facsimile apparatus to which an embodiment of the present invention is applied.
Figure 2B:
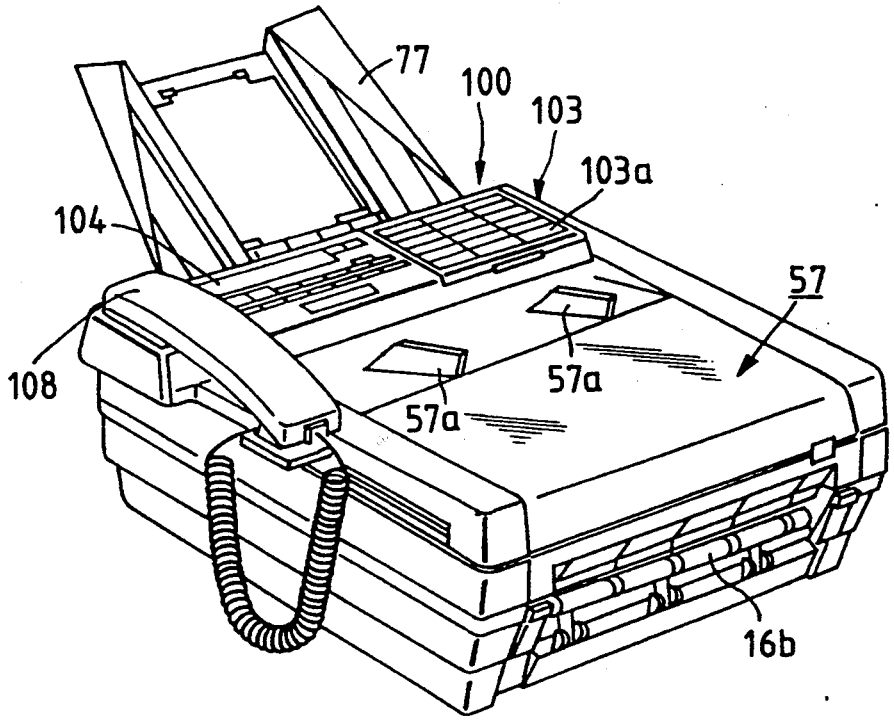
FIG. 2B is a pictorial perspective view of said facsimile apparatus.

FIG. 1 is a block diagram schematically showing the construction of a heat transfer printer using an embodiment of the present invention as it is applied to a facsimile apparatus, FIG. 2A is a side cross-sectional view of the facsimile apparatus, and FIG. 2B is a pictorial perspective view of the facsimile apparatus.

The construction will first be described schematically with reference to FIG. 1.

In FIG. 1, the reference numeral 100 designates a reading unit for photoelectrically reading an original and outputting it as a digital image signal to a control unit 101, and the reading unit 100 is provided with an original conveying motor, a CCD image sensor, etc. The reference numeral 101 designates a control unit for controlling the entire facsimile apparatus, and the control unit 101 codes the image data from the reading unit 100 and transmits it through a modem 106 and an NCU 107. During reception, the control unit 101 decodes the received coded image data and converts in into image data, and outputs it to a recording unit provided with a thermal head, etc. and reproduces the image data. The control unit 101 is provided with a CPU 113 for outputting various control signals in accordance with a control program stored in an ROM 114 and controlling the entire apparatus, an ROM 114 storing therein the control program of the CPU 113 and various data, an RAM 115 for temporarily preserving various data as the working area of the CPU 113, etc. The reference numeral 116 designates a timer used to count the time from the termination of the recording of one line until the next conveyance of the ink sheet or recording medium, as will be described later. This timer 116 is not always necessary, but for example, the time may be counted by software.

The reference numeral 103 denotes an operation unit including keys for designating various functions such as the start of transmission and telephone number input keys. The reference character **103*a* designates a switch for indicating the kind of ink sheet 14 used. When the switch 103*a* is ON, it indicates that a multiprint ink sheet has been mounted, and when the switch 103*a* is OFF, it indicates that an ordinary ink sheet has been mounted. The reference numeral 104 denotes an indicating unit usually provided in the operation unit 103 to indicate various functions and the condition of the apparatus. The reference numeral 106 designates a modem (modulator-demodulator), and the reference numeral 107** denotes a net control unit (NCU).

Before the construction of the recording unit is described, description will first be made with reference to FIG. 2A which is a side cross-sectional view of a facsimile apparatus and FIG. 2B which is a pictorial perspective view of the facsimile apparatus. In FIGS. 2A and 2B, elements corresponding to those in FIG. 1 are designated by similar reference numerals.

In FIGS. 2A and 2B, the reference numeral 10 designates a roll of paper comprising recording paper 11 which is plain paper wound in the form of a roll on a core **10*a*. This roll of paper 10 is rotatably contained so that the recording paper 11 can be supplied to the thermal head 13 by the rotation of a platen roller 12 in the direction of arrow. The reference character 10*b* denotes a loading portion for the roll of paper in which the roll of paper 10 is removably loaded. The platen roller 12 conveys the recording paper 11 in the direction of arrow b and also presses the ink sheet 14 and the recording paper 11 between it and the heat generating member 132 of the thermal head 13. The recording paper 11 on which image recording has been effected by the heat generation of the thermal head 13 is conveyed toward discharge rollers 16a and 16b by further rotation of the platen roller 12, and is cut into a page unit by the meshing engagement between cutters 15*a* and 15*b*** and discharged when image recording by one page is terminated.

The reference numeral 17 denotes an ink sheet supply roll on which the ink sheet 14 is wound. The reference numeral 18 designates an ink sheet take-up roll which is driven by an ink sheet conveying motor 25 to convey the ink sheet 14 in the direction opposite to the direction of conveyance of the recording paper 11, i.e., the direction of arrow a. The ink sheet supply roll 17 and the ink sheet take-up roll 18 are removably loaded in an ink sheet loading portion 70 within the apparatus body. Further, the reference numeral 19 denotes a sensor for detecting the remaining amount of the ink sheet 14 and detecting the conveyance velocity of the ink sheet 14. The reference numeral 20 designates an ink sheet sensor for detecting the presence of the ink sheet 14, and the reference numeral 21 denotes a spring which presses the thermal head 13 against the platen roller 12 with the recording paper 11 and the ink sheet 14 interposed therebetween. The reference numeral 22 designates a recording paper sensor for detecting the presence of the recording paper. The reference numeral 72 denotes a roller for guiding the ink sheet 14.

The construction of the reading unit 100 will now be described.

In FIG. 2A, the reference numeral 30 designates a light source for illuminating an original 32, and the light reflected by the original 32 is input to a CCD sensor 31 through an optical system (mirrors 50, 51 and a lens 52) and converted into an electrical signal. The original 32 is conveyed correspondingly to the reading speed for the original 32 by conveying rollers 53, 54, 55 and 56 driven by an original conveying motor, not shown. The reference numeral 57 denotes an original supporting table, and a plurality of originals 32 supported on this supporting table 57 are separated one by one and conveyed to the reading unit 100 by the cooperation between a conveying roller 54 and a pressing-separating piece 58 while being guided by a slider **57*a*, and are discharged onto a tray 77** after they are read.

The reference numeral 41 designates a control base plate constituting the essential portion of the control unit 101, and various control signals are output from this control base plate 41 to various portions of the apparatus. The reference numeral 106 denotes a modem base plate unit, and the reference numeral 107 designates an NCU base plate unit.

A conveying system for the recording paper 11 and the ink sheet 14 in the recording unit is shown in detail in FIG. 1.

In FIG. 1, the thermal head 13 is a line head which receives as inputs serial recording data corresponding to one line and a latch signal from the control unit 101 by way of a signal line 43 and is driven with a heat generating element which comprises the heat generating resistance member 132 corresponding to one line being divided into a plurality of blocks, thereby effecting the recording of one line. The reference numeral 46 designates a driving circuit which receives as an input a driving signal for the thermal head 13 from the control unit 101 and outputs a strobe signal 44 for driving the thermal head 13 at each block unit. The reference numerals 48 and 49 denote motor driving circuits for rotatively driving the corresponding recording paper conveying motor 24 and ink sheet conveying motor 25, respectively. Further, the reference numerals 26 and 27 designate transmission gears for transmitting the rotation of the recording paper conveying motor 24 to the platen roller 12, and the reference numerals 28 and 29 denote transmission gears for transmitting the rotation of the ink sheet conveying motor 25 to the take-up roll 18. In the present embodiment, the recording paper conveying motor 24 and the ink sheet conveying motor 25 are stepping motors, but this is not restrictive, and they may be, for example, DC motors or the like.

By the directions of conveyance of the recording paper 11 and the ink sheet 14 being thus made opposite to each other, the direction in which images are successively recorded lengthwisely of the recording paper 11 (the direction of arrow a, i.e., the direction opposite to the direction of conveyance of the recording paper 11) and the direction of conveyance of the ink sheet coincide with each other. Here, assuming that the conveyance velocity $V_P$ of the recording paper 11 is $V_P=-n\cdot V_I$ ($V_I$ is a conveyance velocity of the ink sheet 14, and the negative sign shows that the direction of conveyance of the recording paper 11 and the direction of conveyance of the ink sheet 14 differ from each other), the relative velocity $V_{PI}$ of the recording paper 11 and the ink sheet 14 as viewed from the thermal head 13 is expressed by $V_{PI}=V_P-V_I=(1+1/n)V_P$, and from this, it is seen that the relative velocity is $V_P$ or greater, that is, greater than the relative velocity $V_{PI}$ $(=(1-1/n)V_P)$ when the recording paper and the ink sheet were conveyed in the same direction.

Description of Recording Operation (FIGS. 1–5)

Figure 3:
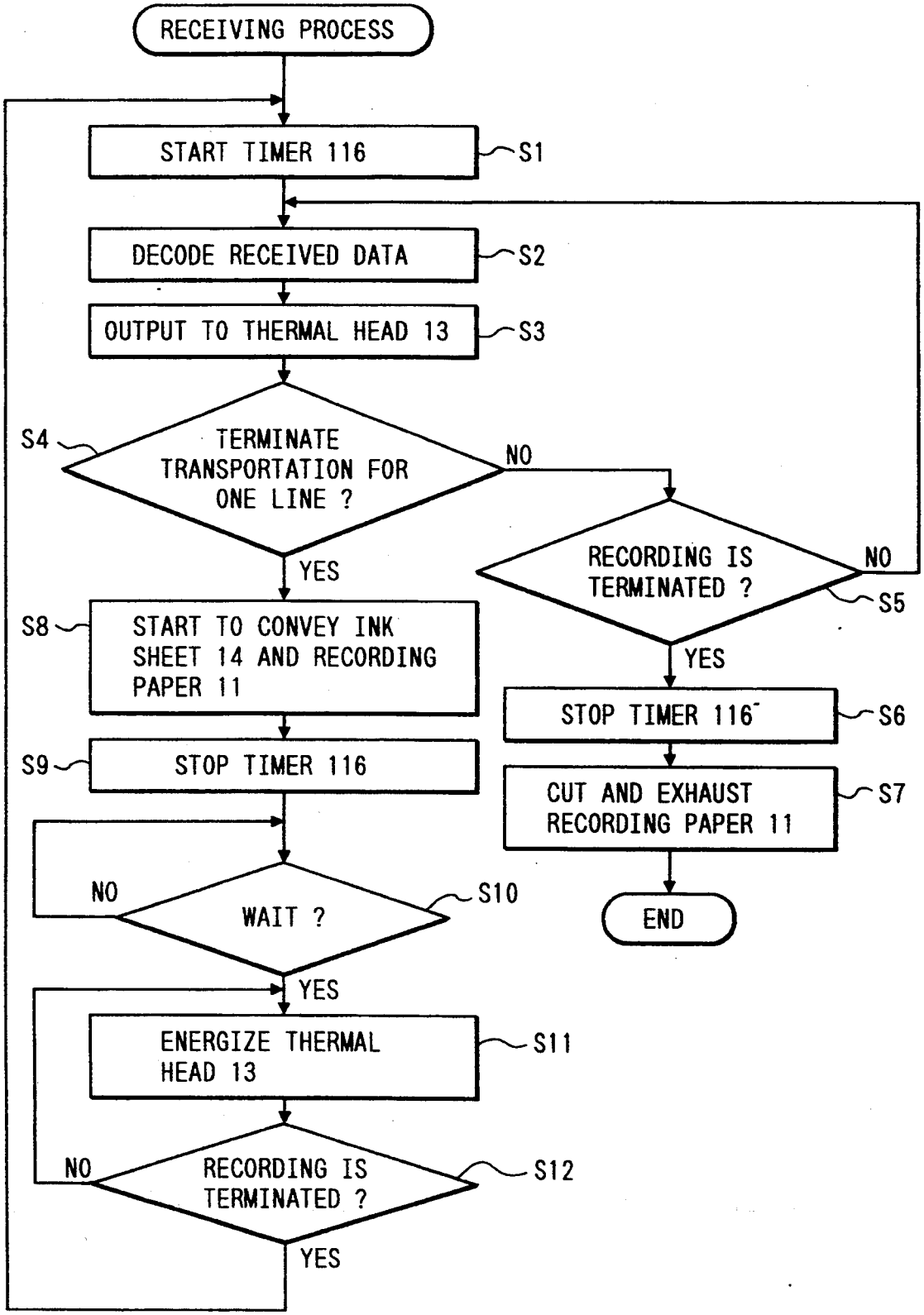
FIG. 3 is a flow chart showing the receiving and recording process in the facsimile apparatus.

FIG. 3 is a flow chart showing the reception of images corresponding to one page in the facsimile apparatus of the present embodiment and the recording process therefor, and the control program of the CPU 113 which executes this process is stored in the ROM 114 of the control unit 101.

This process is started by the image reception of the facsimile apparatus. First, when a facsimile signal is received at step S1, the timer 116 is started. Subsequently, at step S2, the received image signal is decoded, and the decoded image data is serially output to the thermal head 13. Then, at step S4, whether the transportation of the image data for one line to the thermal head 13 has been terminated is examined, and if it is not terminated, whether the image recording process for one page has been terminated is examined at step S5. If the image recording process is not terminated, return is made to the step S2, where the above-described operation is executed, but if the recording process for one page is terminated, advance is made to step S6. At the step S6, the time counting by the timer 116 is stopped, and at step S7, the recorded recording paper is cut by the cutter 15 and the cut recording paper is discharged out of the apparatus.

On the other hand, when at step S4, the image data for one line is transported to the thermal head 13, advance is made to step S8. The ink sheet conveying motor 25 is then driven to convey the ink sheet 14 in the direction of arrow a, whereby the ink sheet 14 is conveyed in the direction of arrow a in FIG. 1 by an amount corresponding to 1/n line. Then, the recording paper conveying motor 24 is driven to convey the recording paper 11 in the direction of arrow b by an amount corresponding to one line. For example, in the facsimile apparatus, the length corresponding to one line is set to about 1/15.4 mm, and the amounts of conveyance of the recording paper 11 and the ink sheet 14 can be set by changing the energization pulse numbers of the motors 24 and 25, respectively. Advance is then made to step S9, where the timer 116 is stopped and the counted value by the timer 116 is read. On the basis of this counted value, the waiting (delay) time is determined, and at step S10, standby is effected for this waiting time.

Figure 4:
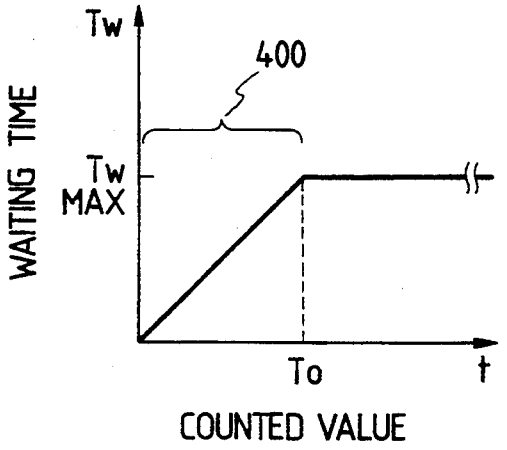
FIG. 4 is a graph showing the relation between the counted value and the waiting time.

FIG. 4 is a graph showing the relation between the counted value and the waiting time.

Here, the counted value indicates the time from after the recording of one line until the next conveyance of the ink sheet or recording medium, and in a section indicated by 400 wherein the counted value is up to "To", as the counted value increases, the waiting time likewise increases. When the counted value is equal to or greater than "To", the waiting time is set so as to be a maximum waiting time $T_{WMAX}$. In FIG. 4, in the section indicated by 400, the waiting time continuously increases substantially in proportion to the increase in the counted value t, but for example, design may be made such that the waiting time increases stepwise relative to the counted value. In the present embodiment, for example, the maximum waiting time $T_{WMAX}$ is 3 [ms] and the counted value To is 30 [ms], although this is not restrictive, and the values may be suitably selected.

When the waiting time thus determined elapses, advance is made to step S11, where the thermal head 13 is electrically energized to effect transfer recording. The thermal head 13 is divided into a plurality of heat generating element groups (blocks) and is electrically energized in block units to effect recording and therefore, at step S12, whether the electrical energization of all blocks of the thermal head 13 has been terminated is examined. When the electrical energization of all blocks is thus terminated, return is made to the step S1, where the timer 116 is started to start the counting of the time till the recording of the next line.

In the series of cutting process for the recording paper 11 by the cutter 15 at the step S7, the movement of the ink sheet 14 when the recording paper 11 is conveyed may be such that as during recording, it is conveyed at a velocity of $V_P/n$ in the direction opposite to the direction of conveyance of the recording paper 11, and the value of n may be made greater than that during recording. Also, the same movement as that of the recording paper 11 may be effected by the platen roller 12, or the ink sheet may remain stopped instead of being moved. In this flow chart, the conveyance of the recording paper 11 is effected at the step S8, but alternatively may be effected when the step S11 is started.

In this embodiment, the recording time required per line is about 2.5 ms, the recording interval is less than about 30 ms, and the waiting time is less than about 2.5 ms.

Figure 5:
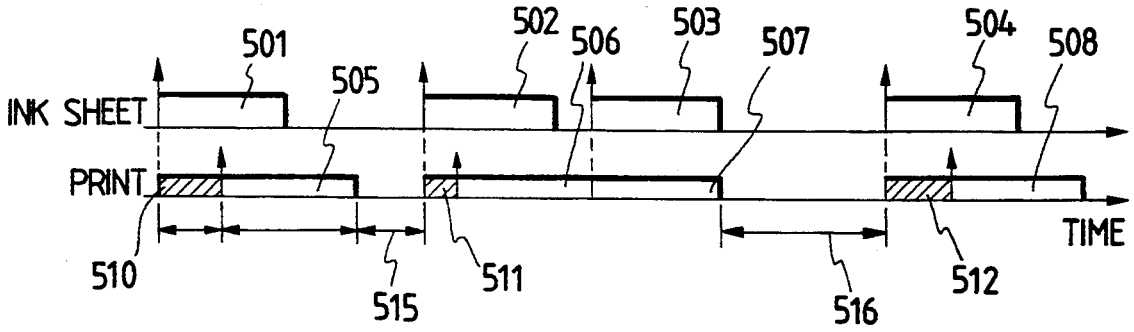
FIG. 5 shows the conveyance of the ink sheet and the recording timing in this embodiment.

FIG. 5 shows the conveyance timing for the ink sheet 14 and the recording paper 11 when the aforedescribed control is effected.

In FIG. 5, 501–504 show the energization time of the ink sheet conveying motor 25 and 505–508 show the recording time by the thermal head 13. Also, 510, 511 and 512 show the waiting time. Further, 515 and 516 show the recording interval counted from the recording of one line till the image conveyance commencement of said ink sheet to record the next one line.

The waiting time shown by 511 is a waiting time determined on the basis of the recording interval shown by 515 which is the interval between the end of recording time 505 and the commencement of ink sheet conveyance 502. Also, the waiting time shown by 512 is a waiting time determined on the basis of the recording interval shown by 516, which is the period following the end of recording period 507 and the start of ink sheet conveyance 504. Further, the recording time 507 has little or no recording interval ("0 (zero)") between it and the recording time 506 for the previous line and therefore, with the waiting time as "0" and in subsequence to the recording time 506, the recording of the next line (shown by 507) is started without a waiting time being provided. Thus, recording is effected without fail after the movement of the ink sheet 14 is started. The aforementioned recording interval may also be found by subtracting the required recording time from the recording period.

In order to reduce the waste of the ink sheet 14 as much as possible, it is desirable to reduce the waiting time as much as possible within a range which can ensure that image recording is to be effected during the movement of the ink sheet 14.

Figure 6:
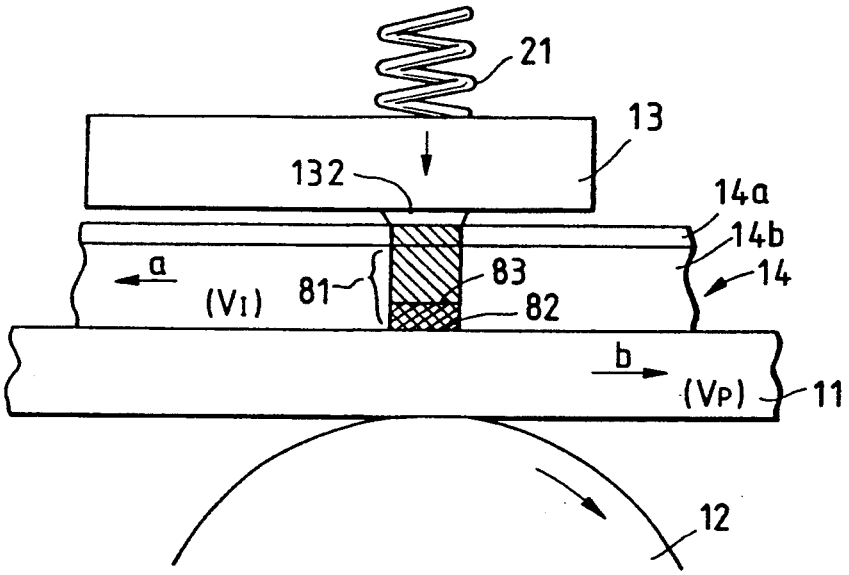
FIG. 6 shows the structure of the ink sheet and the states of the recording paper and the ink sheet during recording.

Description of the Principle of Recording (FIG. 6)

FIG. 6 shows the image recording condition when image recording is effected with the directions of conveyance of the recording paper 11 and the ink sheet 14 in this embodiment made opposite to one another.

As shown, the recording paper 11 and the ink sheet 14 are nipped between the platen roller 12 and the thermal head 13, and the thermal head 13 is urged against the platen roller 12 with a predetermined pressure by the spring 21. The recording paper 11 is conveyed in the direction of arrow b at a velocity Vhd P by the rotation of the platen roller 12. On the other hand, the ink sheet 14 is conveyed in the direction of arrow a at a velocity $V_I$ by the rotation of the ink sheet conveying motor 25.

When the heat generating resistance member 132 of the thermal head 13 is electrically energized and heated, that portion of the ink sheet 14 which is indicated by hatching 81 is heated. The reference character **14*a* designates the base film of the ink sheet 14, and the reference character 14*b* denotes the ink layer of the ink sheet 14. The ink of the ink layer 81 heated by the heat generating resistance member 132 being electrically energized melts, and that portion thereof which is designated by 82 is transferred to the recording paper 11. This ink layer portion 82 transferred corresponds to approximately 1/n of the ink layer designated by 81**.

During this transfer, it is necessary to create a shearing force for the ink on the border line of the ink layer **14*b* to transfer only the ink layer portion 82 to the recording paper 11. However, this shearing force differs depending on the temperature of the ink layer, and tends to become smaller as the temperature of the ink layer becomes higher. So, if the heating time for the ink sheet 14 is shortened, the shearing force which must be applied to the ink layer becomes greater and therefore, if the relative velocity of the ink sheet 14 and the recording paper 11 is made greater, the ink layer to be transferred can be reliably peeled from the ink sheet 14**.

According to this embodiment, the heating time of the thermal head 13 in the facsimile apparatus is as short as about 0.6 ms and therefore, by making the direction of conveyance of the ink sheet 14 and the direction of conveyance of the recording paper 11 opposite to each other, the relative velocity of the ink sheet 14 and the recording paper 11 is increased.

Also, this embodiment has been described with respect to the case where the directions of conveyance of the recording paper 11 and the ink sheet 14 during recording are opposite to each other, but this is not restrictive, and the present invention is also applicable to a case where the recording paper and the ink sheet are conveyed in the same direction and recording is effected.

Figure 7:
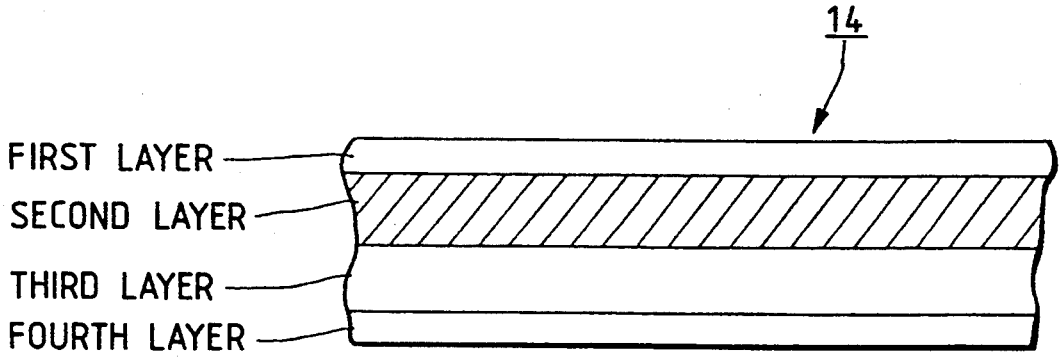
FIG. 7 is a cross-sectional view of the ink sheet used in this embodiment.

Description of the Ink Sheet (FIG. 7)

FIG. 7 is a cross-sectional view of the ink sheet used in the multiprint of the present embodiment, and this ink sheet is constructed of four layers.

A second layer is a base film which provides a support for the ink sheet 14. In the case of multiprint, heat energy is applied to the same portion many times and therefore, the base film may advantageously be an aromatic polyamide film of high heat resistance or condenser paper, but the conventional polyester film will also stand use. The thickness of this layer should advantageously be as small as possible in respect of the quality of printing, from the viewpoint of its role as a medium, but may desirably be 3–8 μm in respect of strength.

A third layer is an ink layer containing therein an amount of ink capable of being transferred to the recording paper (recording sheet) n times. The chief components of this layer are a resin such as EVA as an adhesive agent, carbon black or nigrosine dye for coloring, and carnauba wax or paraffin wax as a binding material, and these are combined so as to stand n times of use in the same portion. The amount of application of these materials may desirably be 4–8 $g/m^2$, but can be selected arbitrarily because sensitivity and concentration differ depending on the amount of application.

A fourth layer is a top coating layer for preventing the ink of the third layer from being pressure-transferred to the recording paper in the portion thereof which should not be printed, and is composed of transparent wax or the like. Thus, it is only the transparent fourth layer that is pressure-transferred, and the ground of the recording paper can be prevented from being stained. A first layer is a heat resisting coat layer for protecting the base film which is the second layer from the heat of the thermal head 13. This is suitable for multiprint having the possibility of heat energy for n lines being applied to the same portion (when black information is continuous), but whether this layer should be used or not can be suitably chosen. Also, this is effective for a base film of relatively low heat resistance such as a polyester film.

The construction of the ink sheet 14 is not limited to this embodiment, but the ink sheet may comprise, for example, a base layer and a porous ink retaining layer provided on one side of the base layer and containing ink therein, or may comprise a base film and a heat resisting ink layer provided on the base film and having a minute porous net-like structure, ink being contained in the ink layer. Also, the material of the base film may be a film composed, for example, of polyimide, polyethylene, polyester, polyvinyl chloride, triacetyl cellulose, nylon or the like, or paper. Further, the heat resisting coat layer is not always necessary, but the material thereof may be silicone resin, epoxy resin, fluorine resin, etholocellulose or the like.

Also, as an example of the ink sheet having heat-sublimating ink, mention may be made of an ink sheet comprising a base material formed of polyethylene terephthalate, polyethylene naphthalate, aromatic polyamide film or the like, spacer particles formed of quanamin resin and fluorine resin, and a color material layer containing a dye therein, said spacer particles and said color material layer being provided on said base material.

The heating system is not limited to the aforedescribed thermal head system using a thermal head, but may be, for example, an electrical energization system or a laser transfer system.

The recording medium is not limited to recording paper, but for example, cloth or a plastic sheet may be mentioned if it is a material capable of ink transfer. The ink sheet is not limited to the roll construction shown in the embodiment, but may be of the so-called ink sheet cassette type in which an ink sheet is contained in a housing removably mountable in the recording apparatus body and the housing is bodily removably mounted in the recording apparatus body.

Furthermore, this embodiment has been described with respect to the case of the full line printer, whereas this is not restrictive, but the so-called serial printer may also be adopted.

According to this embodiment, as described above, a waiting time conforming to the image recording interval is inserted during the time from the start of the conveyance of the ink sheet until image recording is effected, whereby recording can be reliably accomplished with the ink sheet being moved and therefore, the occurrence of an inconvenience such as the recording paper sticking to the ink sheet can be suppressed and the quality of image recording can be kept high.

Also, the embodiment has been described with respect to a case where it is applied to a facsimile apparatus, whereas of course, the present invention is not restricted thereto, but for example, the heat ]0 transfer recording apparatus of the present invention is also applicable to a word processor, a typewriter, a copying apparatus or the like.

According to the present invention, as described above, image recording is effected in a time corresponding to the recording interval after the conveyance driving of the ink sheet, whereby a relative velocity can be reliably created between the recording medium and the ink sheet during image recording and therefore, for example, the recording medium can be prevented from sticking to the ink sheet and thus, the quality of recording can be improved.

We claim:

1. A thermal transfer recording apparatus for transferring an ink of an ink sheet to a recording medium to thereby record images on the recording medium, said apparatus comprising:

conveying means for conveying the ink sheet and the recording medium;

recording means for acting on the ink sheet to effect an image recording on the recording medium;

time counting means for counting a recording interval from a termination of the image recording by said recording means until a start of a next conveyance of at least one of the ink sheet and the recording medium;

determining means for determining a waiting time corresponding to the recording interval counted by said time counting means; and control means for controlling so that a next image recording is performed by said recording means on the recording medium after a lapse of the waiting time determined by said determining means after the start of the next conveyance of at least one of the ink sheet and the recording medium by said conveying means.

2. A thermal transfer recording apparatus according to claim 1, wherein the waiting time is "0" when the recording interval counted by said time counting means is "0".

3. A thermal transfer recording apparatus according to claim 1, wherein said time counting means determines the recording interval by subtracting a required recording time from a recording period.

4. A thermal transfer recording apparatus according to claim 1, wherein said recording means further comprises a thermal head which has a plurality of heat generating elements along a recording width of the recording medium.

5. A thermal transfer recording apparatus according to claim 1, wherein said apparatus is a facsimile apparatus for recording a signal received through a communication line.

6. A thermal transfer recording apparatus according to claim 1 wherein the image is recorded on the recording medium during a recording period, said recording period being defined to begin at a start of a conveyance of the ink sheet and end at the start of the next conveyance of the ink sheet.

7. A thermal transfer recording apparatus according to claim 1 wherein the image is recorded on the recording medium during a recording period, said recording period being defined to begin at a start of a conveyance of the recording medium and end at the start of the next conveyance of the recording medium.

8. A thermal transfer recording apparatus according to claim 1 wherein the waiting time increases in accordance with the recording interval and upon reaching a predetermined value becomes constant.

9. A thermal transfer recording method comprising the steps of:

conveying an ink sheet and a recording medium;

transferring an ink of the ink sheet to the recording medium to thereby record an image on the recording medium;

counting a recording interval from a termination of the image recording until a start of a next conveyance of at least one of the ink sheet and the recording medium;

determining a time until starting a next image recording on the recording medium after a start of a conveyance of the ink sheet; and controlling said time in conformity with said recording interval.

10. A thermal transfer recording method according to claim 9, wherein the ink sheet and the recording medium are conveyed in said conveying step so that a conveyance speed of the ink sheet during the image recording is slower than that of the recording medium during the image recording.

11. A thermal transfer recording method according to claim 9, wherein the ink sheet and the recording medium are conveyed in said conveying step so that a conveyance direction of the ink sheet during the image recording is opposite to that of the recording medium during the image recording.

12. A thermal transfer recording method according to claim 9, wherein the ink of the ink sheet is heat-meltable.

13. A thermal transfer recording method according to claim 9, wherein the ink of the ink sheet is heat-sublimating.

14. A thermal transfer recording method according to claim 9, wherein a recording means for recording is provided in said transferring step, said recording means comprising a thermal head which has a plurality of heat generating elements disposed along a recording width of the recording medium.

15. A thermal transfer recording method according to claim 9, further comprising the step of employing said method in a facsimile apparatus for recording a signal received through a communication line.

16. A thermal transfer recording method according to claim 9 wherein the image is recorded on the recording medium during a recording period, said recording period being defined to begin at a start of a conveyance of the ink sheet and end at the start of the next conveyance of the ink sheet.

17. A thermal transfer recording method according to claim 9 wherein the image is recorded on the recording medium during a recording period, said recording period being defined to begin at a start of a conveyance of the recording medium and end at the start of the next conveyance of the recording medium.

18. A thermal transfer recording method according to claim 9 wherein said time increases in accordance with the recording interval and upon reaching a predetermined value becomes constant.

19. A thermal transfer recording apparatus for transferring ink onto a recording medium to record an image by effecting heat on an ink of an ink sheet, said apparatus comprising:

heating means for acting on the ink sheet to effect the recording of the image on the recording medium;

conveying means for conveying the recording medium and the ink sheet;

time counting means for counting a recording interval from a termination of the image recording until a start of a next conveyance of at least one of the ink sheet and the recording medium;

determining means for determining a time until a next recording of the image on the recording medium is started after a start of a conveyance of the ink sheet by said conveying means; and control means for controlling said time in conformity with said recording interval.

20. A thermal transfer recording apparatus according to claim 19, wherein the ink of the ink sheet is heat-meltable.

21. A thermal transfer recording apparatus according to claim 19, wherein the ink of the ink sheet is heat-sublimating.

22. A thermal transfer recording apparatus according to claim 19, wherein said heating means further comprises a thermal head which has a plurality of heat generating elements along a recording width of the recording medium.

23. A thermal transfer recording apparatus according to claim 19, wherein said apparatus is a facsimile apparatus for recording a signal received through a communication line.

24. A thermal transfer recording apparatus according to claim 19 wherein the image is recorded on the recording medium during a recording period, said recording period being defined to begin at a start of a conveyance of the ink sheet and end at the start of the next conveyance of the ink sheet.

25. A thermal transfer recording apparatus according to claim 19 wherein the image is recorded on the recording medium during a recording period, said recording period being defined to begin at a start of a conveyance of the recording medium and end at the start of the next conveyance of the recording medium.

26. A thermal transfer recording apparatus according to claim 19 wherein said time increases in accordance with the recording interval and upon reaching a predetermined value becomes constant.

27. A thermal transfer recording apparatus comprising:

recording means for effecting recording using an ink sheet containing an ink to record on a recording medium;

conveying means for conveying the ink sheet and the recording medium;

time determining means for determining a first time from a start of a conveyance of the ink sheet to a start of a next recording by said recording means and a second time from a termination of recording by said recording means to a start of a next conveyance of at least one of the ink sheet and recording medium; and changing means for changing said first time in accordance with said second time.

28. A thermal transfer recording apparatus according to any of claims 1, 19, or 27, wherein said conveying means conveys the ink sheet and the recording medium so that a conveyance speed of the ink sheet during the image recording is slower than that of the recording medium during the image recording.

29. A thermal transfer recording apparatus according to any of claims 1, 19, or 27, wherein said conveying means conveys the ink sheet and the recording medium so that a conveyance direction of the ink sheet during the image recording is opposite to that of the recording medium during the image recording.

30. A thermal transfer recording apparatus according to claim 27, wherein said recording means further comprises a thermal head which has a plurality of heat generating elements along a recording width of the recording medium.

31. A thermal transfer recording apparatus according to claim 27, wherein said apparatus is a facsimile apparatus for recording a signal received through a communication line.

* * * * *

UNITED STATES PATENT AND TRADEMARK OFFICE

CERTIFICATE OF CORRECTION

PATENT NO. : 5,410,336

DATED : April 25, 1995

INVENTOR(S) : TAKESHI ONO, ET AL.

It is certified that error appears in the above-identified patent and that said Letters Patent is hereby corrected as shown below:

COLUMN 1

Line 34, "record," should read --recording,--.

COLUMN 2

Line 65, "medium. Waiting" should read --medium is counted by a time counting means. A waiting--.

COLUMN 5

Line 32, "lengthwisely" should read --lengthwise--.
Line 61, "head 13." should read --head 13 at step S3.--.

COLUMN 7

Line 19, "515" should read --515,--.
Line 51, "velocity Vhd P" should read --velocity Vp--.

COLUMN 9

Line 12, "etholocellulose" should read --ethylcellulose--.
Line 35, "printer," should read --type printer--.
Line 36, "printer" should read --type printer--.

UNITED STATES PATENT AND TRADEMARK OFFICE

CERTIFICATE OF CORRECTION

PATENT NO. : 5,410,336

DATED : April 25, 1995

INVENTOR(S) : TAKESHI ONO, ET AL.

It is certified that error appears in the above-identified patent and that said Letters Patent is hereby corrected as shown below:

COLUMN 9

Line 50, "]0" should be deleted.

Signed and Sealed this

Fourteenth Day of November, 1995

Bruce Lehman

*Attest:*

BRUCE LEHMAN

*Attesting Officer*

*Commissioner of Patents and Trademarks*